United States Patent [19]

von Stutterheim et al.

[11] 4,122,366

[45] Oct. 24, 1978

[54] SPARK PLUG

[76] Inventors: Friedrich von Stutterheim, Adenauer Allee 7, 6370 Oberursel; Jörg Wurm, Kantstrasse 19, 8755 Alzenau-Kälberau, both of Fed. Rep. of Germany

[21] Appl. No.: 756,363

[22] Filed: Jan. 3, 1977

[51] Int. Cl.[2] ..... H01T 13/20

[52] U.S. Cl. ..... 313/141; 313/142

[58] Field of Search ..... 313/141, 142; 29/25.12, 29/25.14, 25.17

[56] References Cited

U.S. PATENT DOCUMENTS

| | | | |
|---|---|---|---|
| 3,958,144 | 5/1976 | Franks | 313/141 X |
| 3,967,149 | 6/1976 | Eaton et al. | 313/141 |

*Primary Examiner*—Rudolph V. Rolinec
*Assistant Examiner*—Darwin R. Hostetter
*Attorney, Agent, or Firm*—Richards, Harris & Medlock

[57] ABSTRACT

Spark plug for internal combustion engines with center and ground electrodes consisting of base metals, base metal alloys, or metallic composite materials, said center electrode or both electrodes being coated at least on their ignition areas with a metal or metal alloy having an average atomic weight of more than 100 and a melting point above 1500° C. The metal coating is deposited by crystalline growth on the electrode surface in a thickness of 5 to 100 microns, preferably 15 to 60 microns using the vapor deposition technique or molten salt electrolysis. The cap-shaped coating is applied to the frustro-conical ignition area of the center electrode.

10 Claims, 5 Drawing Figures

SPARK PLUG

Spark plugs usually used for ignition of fuel/air mixtures in internal combustion engines have electrodes of base metals, for example of nickel or nickel alloys. During operation the electrodes show erosion caused by the sparks between the electrodes and due to sputtering and evaporation of the electrode material. The spark erosion at the electrodes increases the electrode gap which results in a shift of the ignition characteristics. Optimal fuel consumption and sparking characteristics can only be achieved with a spark gap which does not appreciably change during operation.

The consumption of electrodes is extremely high if the electrode material tends to react with the gasses in the combustion chamber and develop ceramic-like deposits of metal oxides or metal carbides or if the surface of the electrode in the sparking area is embrittled by adsorption of gases and compounds from the combustion chamber. The passivating or partly passivating insulator- or semiconductor-like coatings are pulled off by the sparks as these ceramic-like coatings do not resist the stresses caused by frequent temperature changes in the phase boundary to the metal. This combination of chemical and physical processes leads to extremely high sparking erosion of the electrodes.

Trials have been performed to increase the lifetime and improve the operation characteristics of spark plugs by using electrodes of platinum or platinum/iridium. In order to reduce the consumption of noble metal, tips of these metals have been welded or soldered onto the electrodes or the electrodes have been enveloped with a platinum foil. Because of the high stresses of sudden temperature changes the soldered or welded joints may become defective and the electrode tips can be loosened and will finally fall off. Because of the corrosion phenomena between the electrodes and the welded or soldered tips an excessive amount of noble metal above that necessary to reduce the electrode erosion is required for making the joints between electrodes and tips. The high noble metal consumption for such spark plugs makes them too expensive for their general use apart from heavy duty and special engines.

This is valid for spark plugs, too, which have been coated by commonly known electroplating processes in aqueous solutions at low temperatures as described in U.S. Pat. Nos. 2,470,033 and 2,391,458. The erosion of these coatings is remarkable, caused by poor adhesion, fine-grained and often laminated crystalline structures and their tendency to become brittle and to form cracks. Therefore, coating thicknesses of more than 100 $\mu$m, for example 635 $\mu$m on the center electrode and 254 $\mu$m on the ground electrode (cf. U.S. Pat. No. 2,470,033) are considered necessary. Up to now such spark plugs have not succeeded commercially.

It is an object of the present invention to produce spark plugs which show as little spark erosion as possible and guarantee an optimum spark timing and fuel combustion over a long time period. Especially, one should be able to produce spark plugs of the present invention more economically than the 'platinum spark plugs' presently available.

The invention proposes a spark plug which is characterized by an ignition tip of the center electrode which has a frusto-conical end tapering to a flat surface and is coated at the front surface and also partly at the adjacent cone shell surfaces by molten salt electrolysis or a vapor deposition procedure with a crystalline metal layer of a thickness $d_s$ between 5 and 100, preferably 15 to 60 $\mu$m. The shaft diameter of the cylindrical center electrode is by 2 $d_s$ to 10 $d_s$ larger than the diameter of the front face. The cone shell surfaces of the frusto-conical electrode tip are coated with the same metal in a length of 0.5 $d_s$ to 10 $d_s$.

Absolutely unexpectedly it has been found that even thinnest coatings on the ignition tip are sufficient to suppress spark erosion extensively as long as suitable metals are chosen and deposited in the form of ductile, well-adhering layers of columnar structure which are formed by high-temperature coating processes. As far as spark erosion is caused by evaporation of the electrode material it depends on vapor pressure and indirectly on the melting point of the metal. In this respect metals and metal alloys with a melting temperature above 1500° C. show outstanding properties. As far as spark erosion is due to sputtering of the electrode this can be substantially suppressed by using metals or metal alloys with an average atomic weight of more than 100, as the transfer of kinetic energy between ions of the gas atmosphere and atoms of the metal surface is small, especially in comparison to nickel (atomic weight 58.7). The metals used for the protecting layers possess a high thermal conductivity and thus help to avoid overheating at the electrode tip due to localized heat evolution.

It is important for the success of the invention that the coating metals are chemically inert and resist reactions with the gasses and compounds during combustion. Furthermore, they should not absorb gasses from the combustion chamber as otherwise the surface layers will become brittle.

Finally, the electrode material can promote the ignition process and the initiation of combustion by acting as a heterogenic catalytic contact either by catalytic cracking or oxidation of fuel hydrocarbons. Especially the metals of the platinum group are known for their excellent catalytic cracking and oxidizing properties; the same is valid for rhenium, too.

Summarizing, the coating metals should exhibit a combination of the following properties:

(a) a melting point higher than 1500° C.
(b) a high thermal conductivity
(c) an average atomic weight above 100
(d) as small a reactivity as possible with the constituents of the fuel/air mixture as well as with the combustion gasses
(e) as low a tendency as possible to embrittlement by absorption of compounds of the combustion chamber
(f) a catalytic activity for cracking and/or oxidation of hydrocarbons.

Suitable metals are, first of all, the elements of the platinum group like platinum, palladium, ruthenium, rhodium, iridium, osmium, and, further, rhenium. Also, their alloys with one another or with other metals are useful. When using alloys the decrease in thermal conductivity in comparison to pure metals is compensated by the advantage of an exact adjustment of the melting point and indirectly of the vapor pressure. The extraordinarily high prices of iridium and osmium compared to platinum can be compensated by using thinner coatings or by using osmirid, the genetical osmium/iridium alloy, which is difficult to separate into its components and is therefore much less expensive.

The electrodes preferably consist of a base metal with as good a thermal conductivity as possible, e.g. electrodes of nickel or of a nickel jacket and a copper core or another proper material. Normally, the spark erosion of the center electrode is remarkably higher than that of the ground electrode. It is therefore especially important to protect the spark base of the center electrode against erosion according to the invention. The ground electrode can of course be coated in the same way. However, the thermal stress on the ground electrode is smaller than on the center electrode. Said negatively polarized center electrode is surrounded by an insulator and exposed to the bombardement of heavy positive ions from the gas atmosphere and to localized heat evolution. The lifetime of a spark plug is primarily limited by spark erosion of its center electrode. First of all, the erosion of the center electrode has to be reduced.

The metal layer on the ignition area needs such a shape that the phase boundary between the layer and the bulk electrode, accessible for combustion gasses, is farther distant from the base of the sparks with the highest thermal stress.

For an economical use of layer metal and its adhesion to the electrode without welding and soldering expedients this invention uses deposition techniques which allow to coat even complicated shapes of electrode tips with smooth and well-adhering crystalline layers of every coating thickness between 5 and 100 $\mu$m, especially 15 to 60 $\mu$m. Layers are considered here which are formed by crystalline growth at high temperatures by the use of vapor deposition or molten salt electrolysis. Especially such deposition processes allow coating of an electrode tip with a cap-shaped noble metal layer as will be further explained.

Vapor deposition can take place either by evaporation of noble metals or by thermal decomposition or reduction of suitable volatile noble metal compounds, i.e. chemical vapor deposition. Preferably, molten salt electrolytic processes are used like those described in U.S. Pat. Nos. 2,093,406; 2,292,766; 3,309,292; and 3,547,789. It is especially preferred to use the process described in German Auslegeschrift No. 2,417,424 where solutions of noble metal salts in alkali metal cyanamide and/or thiocyanate and/or cyanide and/or halide metals which optionally contain alkali carbonate and/or cyanate are used for molten salt electrolysis. Said process for dissolving the metals is characterized by adding substances to the melt which form under reaction conditions CN, CNO, or SCN radicals in the melt.

The coating of spark plug electrodes by molten salt electrolysis involves several remarkable advantages:

(a) Very pure metal coatings also in respect to the inclusion of non-metallic additives can be deposited.

(b) Because of relatively high process temperatures it is possible to produce extremely well-adhering coatings of each chosen metal.

(c) The layer adhesion can further be improved by increasing the deposition temperature to a temperature where the deposited metal diffuses into the base metal. On the other hand, it is possible to attain diffusion by a heat treatment following the deposition.

(d) Nearly all metals can be deposited as a suitable crystalline coating in a wide range of temperatures and with every desired thickness according to the process of German Auslegeschrift No. 2,417,424.

By using these coating processes one can efficiently manufacture larger quantities of plugs which meet all requirements of layer thickness, adhesion to the metal substrate, purity of the deposit, versatility of the process when coating odd-shaped electrode tips, high deposition rates as well as the possibility to deposit a large number of different metals or their alloys. After deposition it is possible to smooth the coating by mechanical finishing like hammering, grinding, polishing, and the like, if necessary.

According to the invention the coating on the center electrode is cap-shaped and thus covers not only the total front area but further extends to the adjacent cone shell surfaces of the electrode. This shape guarantees excellent heat conduction in comparison to bulk electrode pins of platinum/iridium wire or ribbon even if alloys instead of pure metals are used. This is mainly caused by the availability of a large interface for heat conduction between layer and substrate.

The cap-shaped metal coating on the tip of the center electrode turns out to be especially favorable if its ignition tip has a frusto-conical shape whereas the shaft remains cylindrical as usual. Preferably, the frusto-conical tip is coated over the front face and a small adjacent region with a cap of platinum, another platinum metal, rhenium or an alloy of these metals. Thereby the cap, adjacent to the front face, also covers part of the cone shell surfaces of the frustum of the cone in a height of at least half the thickness of the front layer, normally, however, with 1 to 10 times this thickness. The result will be that the exposed phase boundary between layer and bulk electrode is distant enough from the region of the highest thermal stress. The conicity of the electrode tip is favorably chosen in its geometry so that after the depositing of the metal cap nowhere the diameter of the cylindrical electrode shaft is exceeded. This facilitates the masking to coat the electrodes partially with the cap-shaped layer and to remove them from the holding device used during the coating procedure.

A more complete understanding of the invention may be had by reference to the following detailed description when taken in conjunction with the accompanying drawings, wherein.

Figure 1:
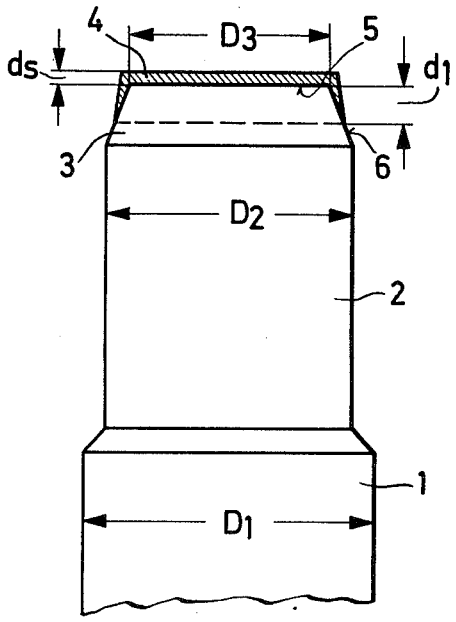
FIG. 1 is an illustration of the center electrode of a spark plug incorporating a first embodiment of the invention.
Figure 2:
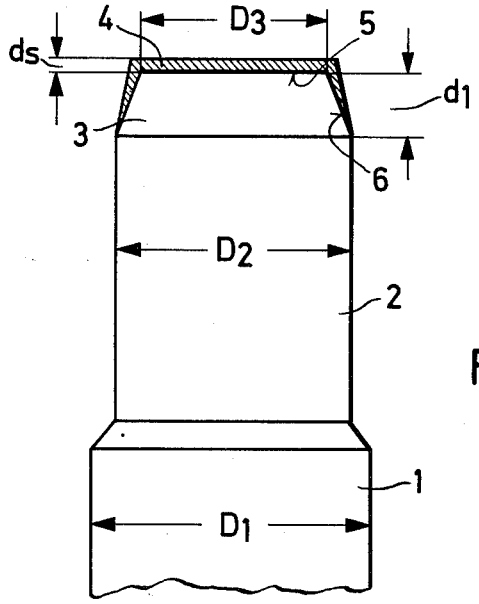
FIG. 2 is an illustration of a center electrode of a spark plug incorporating a second embodiment of the invention.

The center electrodes shown in FIGS. 1 and 2 have a cylindrical shaft 1 of a diameter $D_1$ which tapers to a cylindrical part 2 of a diameter $D_2$. The electrode ends in a tip 3 shaped as a truncated cone, reducing the electrode diameter at the front face to $D_3 \leqq D_2 - a.d_s$. Factor $a$, the multiple of the layer thickness by which $D_2$ is at least tapered to $D_3$ can have any value between 2 and 10. For coating reasons the lower limit for this reduction is given by $D_3 \leqq D_2 - 2d_s$ with $D_3 = D_2$ after deposition. For forming the cap on the electrode tip according to the invention $d_1$ must have a value between 0.5 and 10 $d_s$, $d_s$ being the layer thickness on the front face 5. The height of the truncated cone tip accordingly depends on the choice of $d_s$ and $d_1$.

The embodiments of FIGS. 1 and 2 differ from each other in that cap 4 of FIG. 1 covers the shell surface of the cone only partly but completely in FIG. 2.

Figure 5:
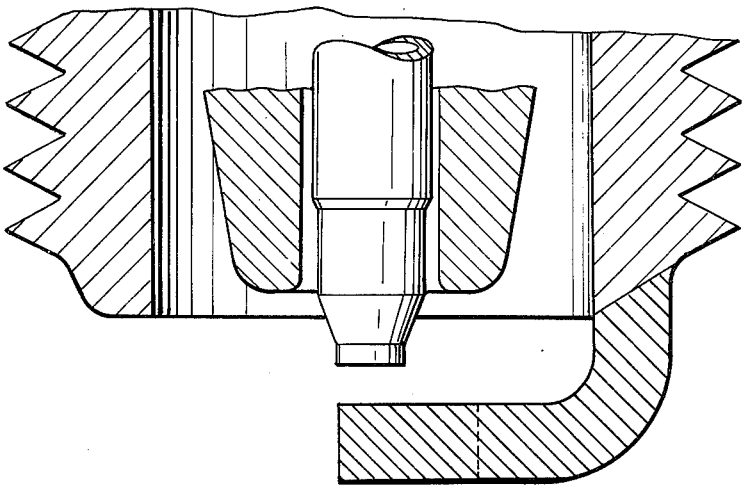
Fig. 5 Prior Art
FIG. 5 is an illustration of a prior art spark plug structure.
Figure 3:
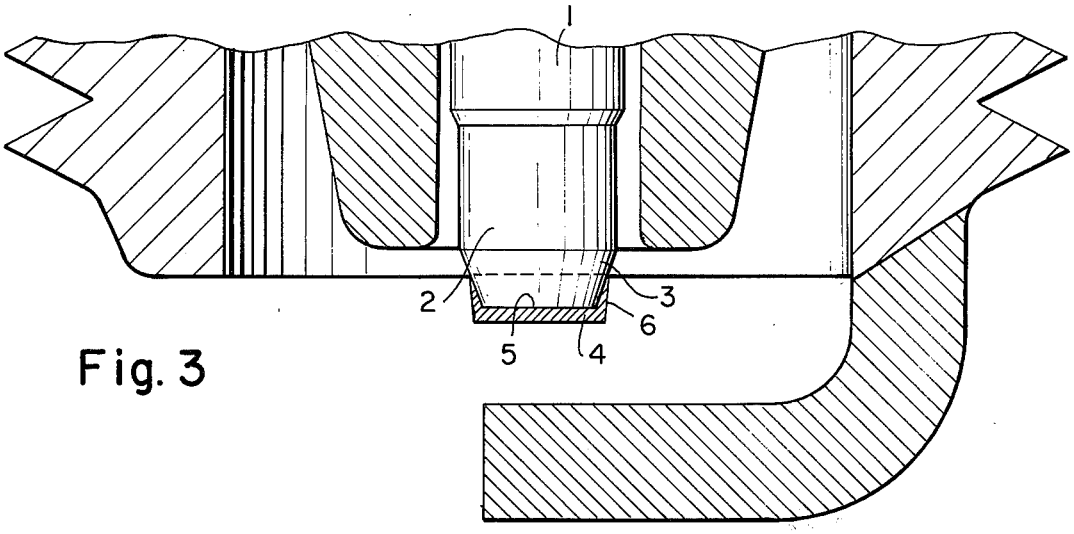
FIG. 3 is an illustration of a spark plug incorporating the center electrode of FIG. 1.
Figure 4:
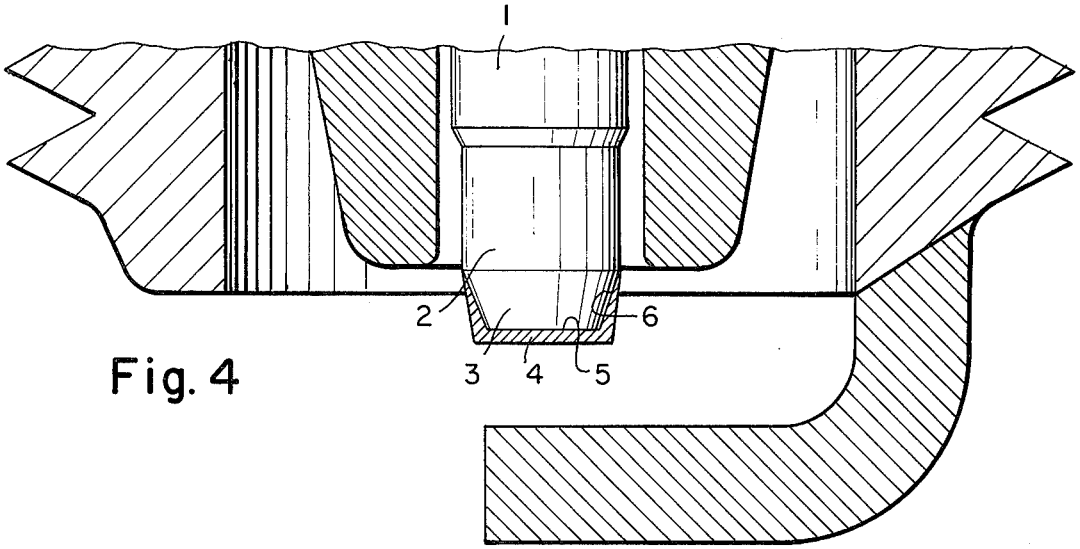
FIG. 4 is an illustration of a spark plug incorporating the center electrode of FIG. 2.

FIG. 3 illustrates a spark plug structure having the center electrode of FIG. 1 incorporated therein. FIG. 4 illustrates a spark plug structure having the electrode of FIG. 2 incorporated therein. When FIGS. 3 and 4 are compared with the prior art spark plug structure illustrated in FIG. 5, it will be understood that the spark plug structures of FIGS. 3 and 4 are entirely identical to the prior art except for the center electrodes thereof.

Because of the new properties explained above the spark plugs of the invention show extremely low spark erosion even for coatings being only 10 and 50 microns thick, thus the ignition gap remains practically constant over an unusually long running period of the engine. The extremely low noble metal consumption allows an economical manufacture of these spark plugs (in comparison to the known 'platinum spark plugs' with a pin of platinum or a platinum metal or in comparison to an electroplated deposit from an aqueous solution the consumption of the layer metal is reduced to between 1/5 and 1/100). For this reason the present spark plugs can not only be used in special engines but also in regular engines of standard automobiles where they make it possible to optimize ignition time and fuel consumption because of the stability of the electrode gap and the catalytic action of the coated electrode tip.

What we claim is:

1. A spark plug for internal combustion engines, having a center electrode coated at least on its ignition area with a metal or metal alloy having an average atomic weight above 100 and a melting point above 1500° C., said metal or metal alloy coating on the ignition area being deposited by crystalline growth using molten salt electrolysis in a thickness $d_s$ in the range of 5 to 100 microns.

2. A spark plug according to claim 1 wherein said coating has a thickness in the range of 15 to 60 microns.

3. A spark plug according to claim 1 wherein the center electrode has a front face and a frustro-conical cone shell surface and wherein the diameter of the cylindrical electrode shaft is by 2 $d_2$ to 10 $d_s$ larger than the diameter of the front face and the total front face and the frustro-conical cone shell surface is coated with the metal at a length of 0.5 $d_s$ to 10 $d_s$.

4. A spark plug according to claim 1 wherein the metal coating adheres to the electrode by an interlayer developed by interdiffusion.

5. A spark plug according to claim 1 wherein the surface of the metal coating is smoothened by a mechanical after-treatment.

6. A spark plug for internal combustion engines having a center electrode coated at least on its ignition area with a metal or metal alloy having an average atomic weight above 100 and a melting point above 1500° C., said metal or metal alloy coating on the ignition area being deposited by crystalline growth using vapor deposition in a thickness $d_s$ in the range of 5 to 100 microns.

7. A spark plug according to claim 6 wherein said coating has a thickness in the range of 15 to 60 microns.

8. A spark plug according to claim 6 wherein the center electrode has a front face and a frustro-conical cone shell surface and wherein the diameter of the cylindrical electrode shaft is by 2 $d_s$ to 10 $d_s$ larger than the diameter of the front face and the total front face and the frustro-conical cone shell surface is coated with the metal at a length of 0.5 $d_s$ to 10 $d_s$.

9. A spark plug according to claim 6 wherein the metal coating adheres to the electrode by an interlayer developed by interdiffusion.

10. A spark plug according to claim 6 wherein the surface of the metal coating is smoothed by mechanical after treatment.

* * * * *

UNITED STATES PATENT AND TRADEMARK OFFICE

CERTIFICATE OF CORRECTION

PATENT NO. : 4,122,366

DATED : October 24, 1978

INVENTOR(S) : Friedrich von Stutterheim and Jorg Wurm

It is certified that error appears in the above-identified patent and that said Letters Patent are hereby corrected as shown below:

Column 6, line 6, "$2d_2$" should read --$2d_s$--

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*